US011271343B2

(12) United States Patent
Lee

(10) Patent No.: US 11,271,343 B2
(45) Date of Patent: Mar. 8, 2022

(54) PLUG ASSEMBLY

(71) Applicant: James Cheng Lee, La Habra, CA (US)

(72) Inventor: James Cheng Lee, La Habra, CA (US)

( * ) Notice: Subject to any disclaimer, the term of this patent is extended or adjusted under 35 U.S.C. 154(b) by 129 days.

(21) Appl. No.: 16/855,241

(22) Filed: Apr. 22, 2020

(65) Prior Publication Data

US 2021/0333485 A1 Oct. 28, 2021

(51) Int. Cl.
*H01R 13/58* (2006.01)

(52) U.S. Cl.
CPC ..... *H01R 13/582* (2013.01)

(58) Field of Classification Search
None
See application file for complete search history.

(56) References Cited

U.S. PATENT DOCUMENTS 7,449,639 B2 * 11/2008 Nair ..... H01B 7/0876 174/113 R
8,708,752 B2 * 4/2014 Wu ..... H01R 9/032 439/660
2019/0140374 A1 * 5/2019 Wu ..... H01R 43/0263

* cited by examiner

*Primary Examiner* — Ross N Gushi
(74) *Attorney, Agent, or Firm* — Lin & Associates Intellectual Property, Inc.

(57) ABSTRACT

A plug assembly includes a lower cover and an upper cover. The lower cover has two lower lateral walls and a lower rear wall. A top surface of a lower portion of the lower cover, the two lower lateral walls and the lower rear wall surround a lower accommodating space. The lower accommodating space has at least one lower embedding portion. The upper cover is assembled to the lower cover. The upper cover has two upper lateral walls and an upper rear wall. A bottom surface of an upper portion of the upper cover, the two upper lateral walls and the upper rear wall surround an upper accommodating space. The upper accommodating space is combined with the lower accommodating space to form an accommodating space. The upper accommodating space has at least one upper embedding portion disposed corresponding to the at least one lower embedding portion.

7 Claims, 11 Drawing Sheets

PLUG ASSEMBLY

BACKGROUND OF THE INVENTION

1. Field of the Invention

The present invention generally relates to a plug assembly, and more particularly to a plug assembly having a function of lowering outward radiation losses of a plurality of external cables of the plug assembly.

2. The Related Art

Generally, a rear end of a foregoing quad small form-factor pluggable (QSFP) interface is connected with a plurality of external cables, because the plurality of the external cables are limited by a QSFP space, insulation layers of the plurality of the external cables must be peeled off for shortening outer diameter dimensions of the plurality of the external cables, the plurality of the external cables are integrated by heat-shrinkable tubes, and then the plurality of the external cables and the heat-shrinkable tubes are assembled to an upper cover and a lower cover to be fastened.

However, because the insulation layers of the plurality of the external cables are peeled off, copper foils are exposed outside from the plurality of the external cables, electromagnetic fields of the plurality of the external cables are dissipated in the air or other mediums to loss energies, namely radiation losses are increased, the energies lower a transmission capacity of the plurality of the external cables, and if the energies are coupled to other devices, the energies cause interferences to other devices too.

Therefore, it is necessary to provide an innovative plug assembly, the innovative plug assembly includes a plurality of external cables, and the innovative plug assembly has a function of lowering outward radiation losses of the plurality of the external cables of the innovative plug assembly for preventing affecting other devices.

SUMMARY OF THE INVENTION

An object of the present invention is to provide a plug assembly. The plug assembly includes a lower cover and an upper cover. Two sides of the lower cover have two lower lateral walls protruding upward, and a rear end of the lower cover has a lower rear wall protruding upward. A top surface of a lower portion of the lower cover, the two lower lateral walls and the lower rear wall surround a lower accommodating space. The lower rear wall opens a lower external interface communicated with the lower accommodating space. The lower accommodating space has at least one lower embedding portion protruded upward from the top surface of the lower portion of the lower cover and connected with inner surfaces of the two lower lateral walls. The upper cover is assembled to the lower cover. Two sides of the upper cover have two upper lateral walls protruding downward and corresponding to the two lower lateral walls. A rear end of the upper cover has an upper rear wall protruding downward and corresponding to the lower rear wall. A bottom surface of an upper portion of the upper cover, the two upper lateral walls and the upper rear wall surround an upper accommodating space corresponding to the lower accommodating space. The upper accommodating space is combined with the lower accommodating space to form an accommodating space. The upper rear wall opens an upper external interface communicated with the upper accommodating space and disposed corresponding to the lower external interface. The upper external interface is combined with the lower external interface to form an external interface. The upper accommodating space has at least one upper embedding portion protruded downward from the bottom surface of the upper portion of the upper cover and connected with inner surfaces of the two upper lateral walls. The at least one upper embedding portion is disposed corresponding to the at least one lower embedding portion.

Another object of the present invention is to provide a plug assembly adapted for being connected with a plurality of external cables. The plug assembly includes a lower cover, an upper cover and a circuit board. The lower cover has two lower lateral walls protruding upward, and a lower rear wall protruding upward. A top surface of a lower portion of the lower cover, the two lower lateral walls and the lower rear wall surround a lower accommodating space. The lower rear wall opens a lower external interface communicated with the lower accommodating space. The lower accommodating space has at least one lower embedding portion protruded upward from the top surface of the lower portion of the lower cover and connected with inner surfaces of the two lower lateral walls. The upper cover is assembled to the lower cover. The upper cover has two upper lateral walls protruding downward and corresponding to the two lower lateral walls, and an upper rear wall protruding downward and corresponding to the lower rear wall. A bottom surface of an upper portion of the upper cover, the two upper lateral walls and the upper rear wall surround an upper accommodating space corresponding to the lower accommodating space. The upper accommodating space is combined with the lower accommodating space to form an accommodating space. The upper rear wall opens an upper external interface communicated with the upper accommodating space and disposed corresponding to the lower external interface. The upper external interface is combined with the lower external interface to form an external interface. The upper accommodating space has at least one upper embedding portion protruded downward from the bottom surface of the upper portion of the upper cover and connected with inner surfaces of the two upper lateral walls. The at least one upper embedding portion is disposed corresponding to the at least one lower embedding portion. The circuit board is accommodated in the accommodating space. The plurality of the external cables are connected with a rear end of the circuit board through the external interface. Fronts of the plurality of the external cables are accommodated in the accommodating space. The plurality of the external cables are pressed between the at least one upper embedding portion and the at least one lower embedding portion.

Another object of the present invention is to provide a plug assembly. The plug assembly includes a lower cover and an upper cover. The lower cover has a lower base board. Two sides of the lower base board protrude upward to form two lower lateral walls. A rear end of the lower base board protrudes upward to form a lower rear wall. The lower base board, the two lower lateral walls and the lower rear wall surround a lower accommodating space. A top of the lower rear wall is recessed downward to form a lower external interface communicated with the lower accommodating space. The lower accommodating space has at least one lower embedding portion protruded inward from a top surface of the lower base board and connected with inner surfaces of the two lower lateral walls. The upper cover assembled to the lower cover, has an upper base board, two sides of the upper base board protruding downward to form two upper lateral walls disposed corresponding to the two lower lateral walls. A rear end of the upper base board protrudes downward to form an upper rear wall disposed corresponding to the lower rear wall. The upper base board, the two upper lateral walls and the upper rear wall surround an upper accommodating space disposed corresponding to the lower accommodating space. The upper accommodating space is combined with the lower accommodating space to form an accommodating space. A bottom surface of the upper rear wall is recessed upward to form an upper external interface disposed corresponding to the lower external interface. The upper external interface is combined with the lower external interface to form an external interface. The upper accommodating space has at least one upper embedding portion protruded downward from a bottom surface of the upper base board and connected with inner surfaces of the two upper lateral walls. The at least one upper embedding portion is disposed corresponding to the at least one lower embedding portion.

As described above, the plurality of the external cables are directly embedded and fastened in the plug assembly by virtue of disposing the at least one upper embedding portion, the at least one lower embedding portion and the external interface, a previous procedure of peeling off insulation layers of the plurality of the external cables is saved, and radiation losses dissipated from the plurality of the external cables are also lowered.

BRIEF DESCRIPTION OF THE DRAWINGS #

The present invention will be apparent to those skilled in the art by reading the following description, with reference to the attached drawings, in which.

DETAILED DESCRIPTION OF THE PREFERRED EMBODIMENT

Figure 1:
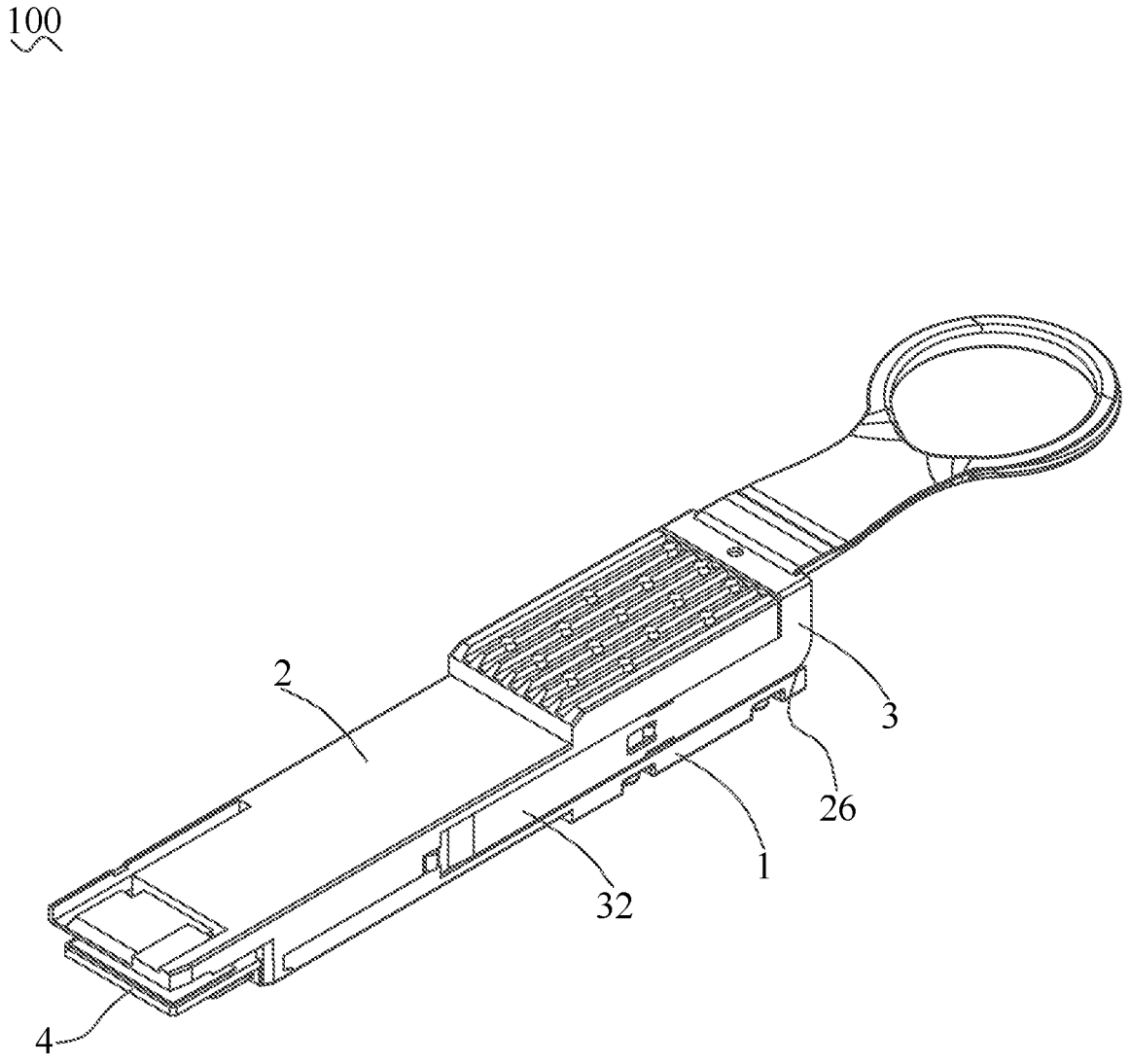
FIG. 1 is a perspective view of a plug assembly in accordance with a first preferred embodiment of the present invention.
Figure 2:
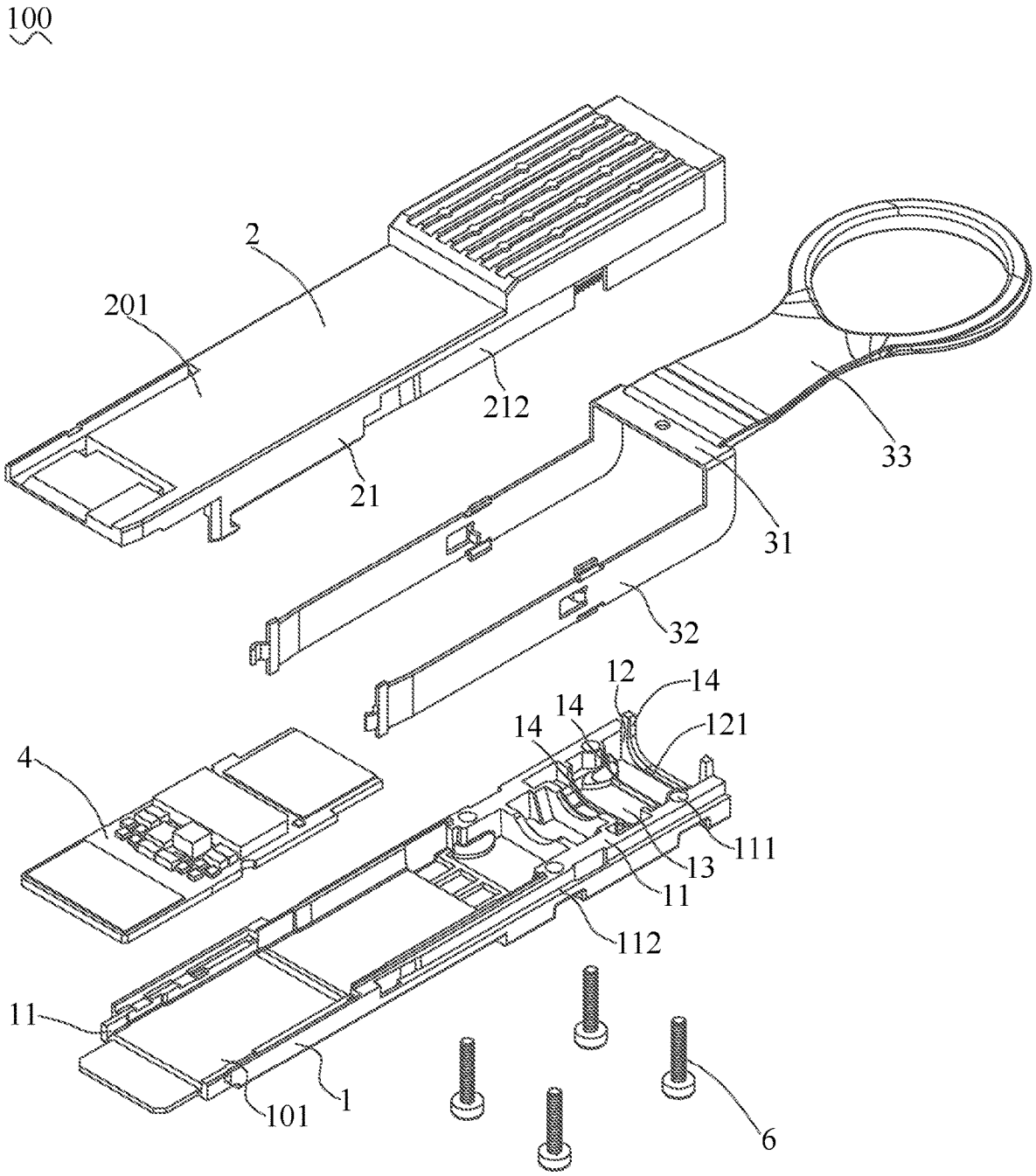
FIG. 2 is an exploded perspective view of the plug assembly of FIG. 1.
Figure 3:
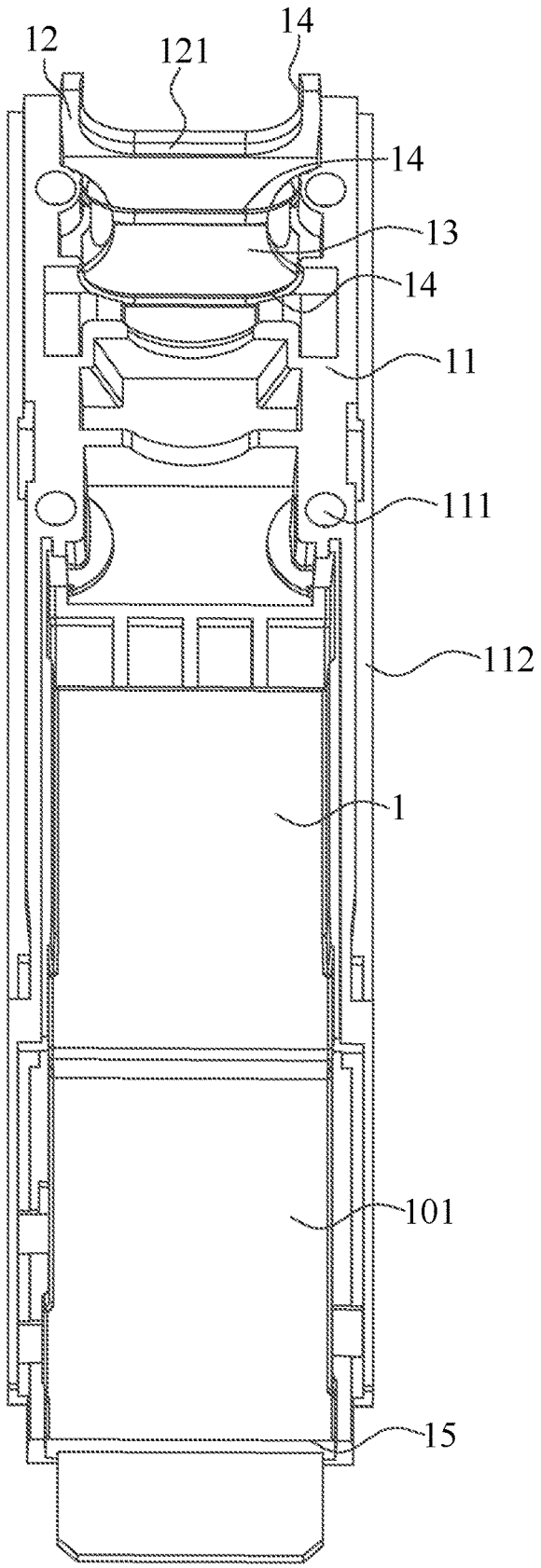
FIG. 3 is a perspective view of a lower cover of the plug assembly of FIG. 1.
Figure 4:
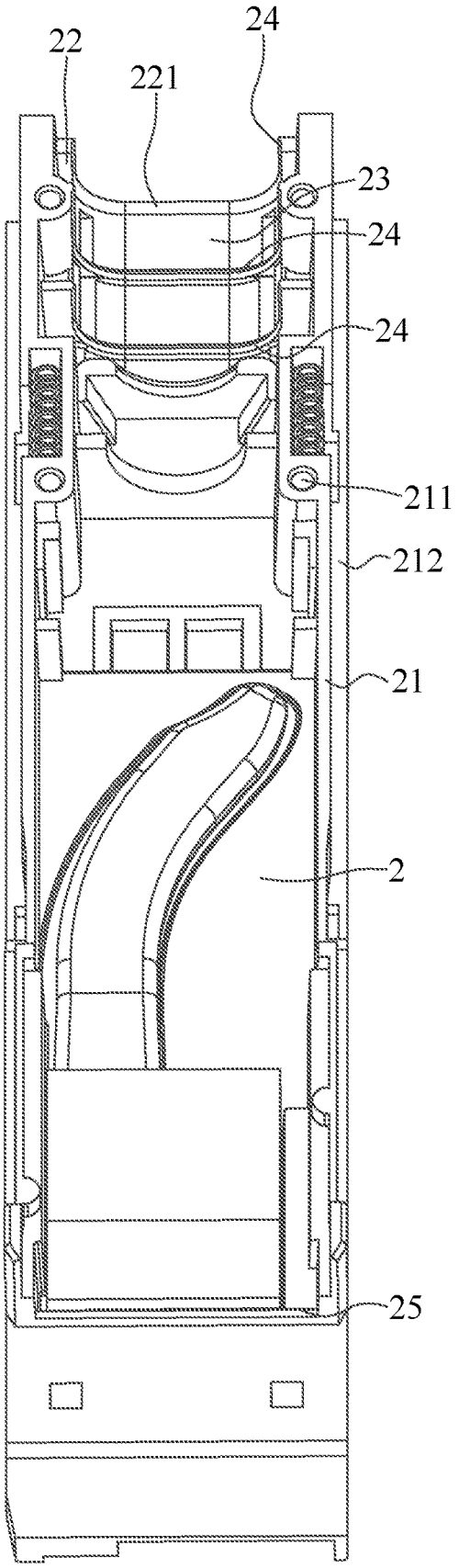
FIG. 4 is a perspective view of an upper cover of the plug assembly of FIG. 1.
Figure 5:
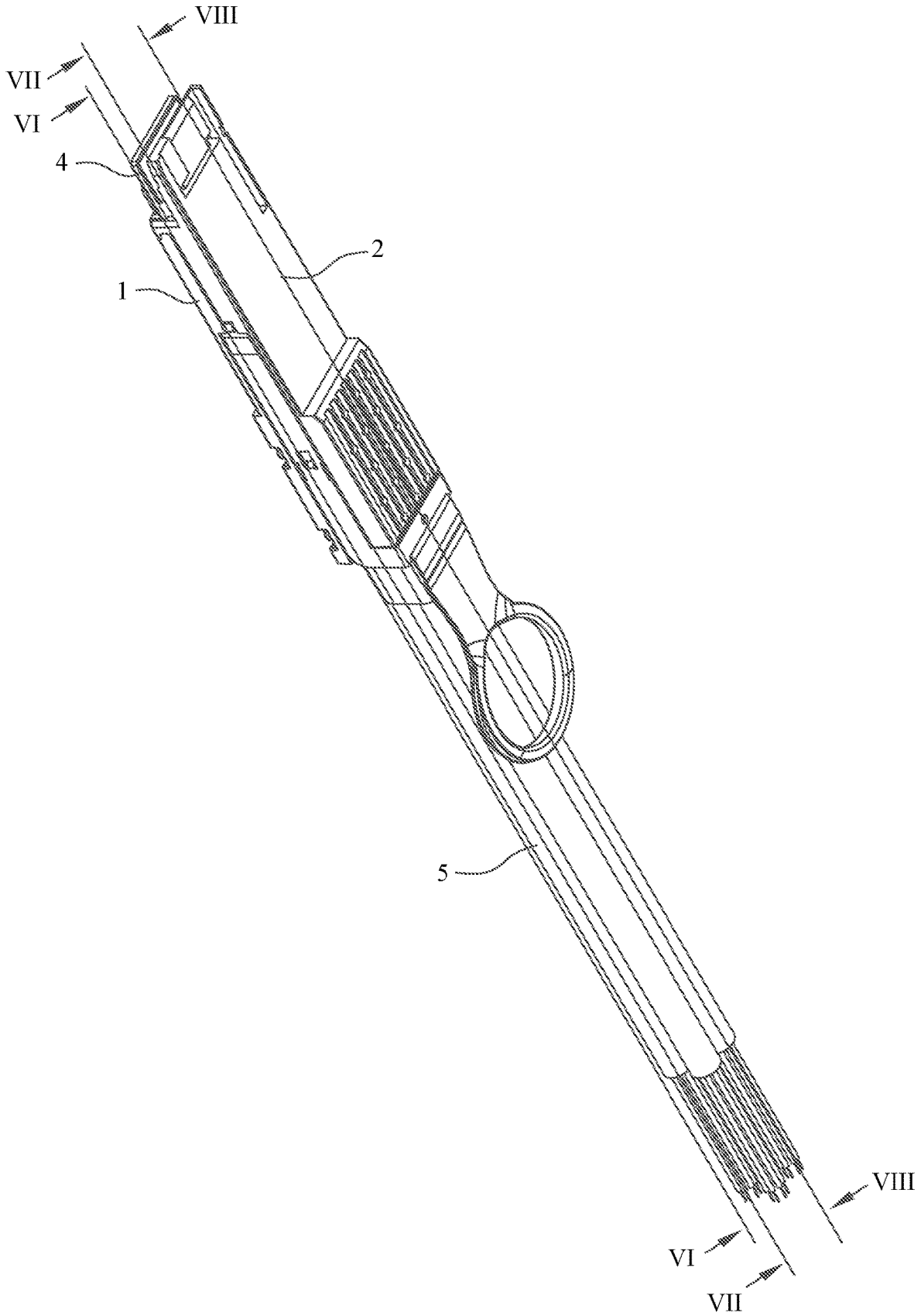
FIG. 5 is a perspective view showing that a plurality of external cables are assembled with the plug assembly of FIG. 1.
Figure 6:
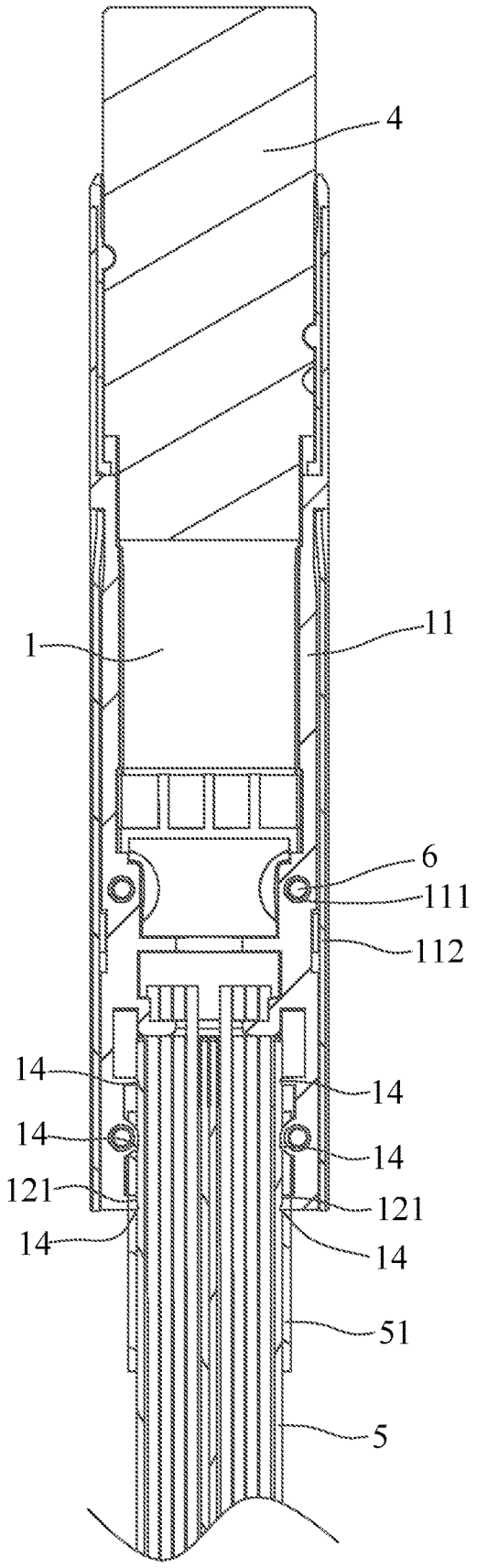
FIG. 6 is a cross-section view of the plug assembly along a line VI-VI of FIG. 5.
Figure 7:
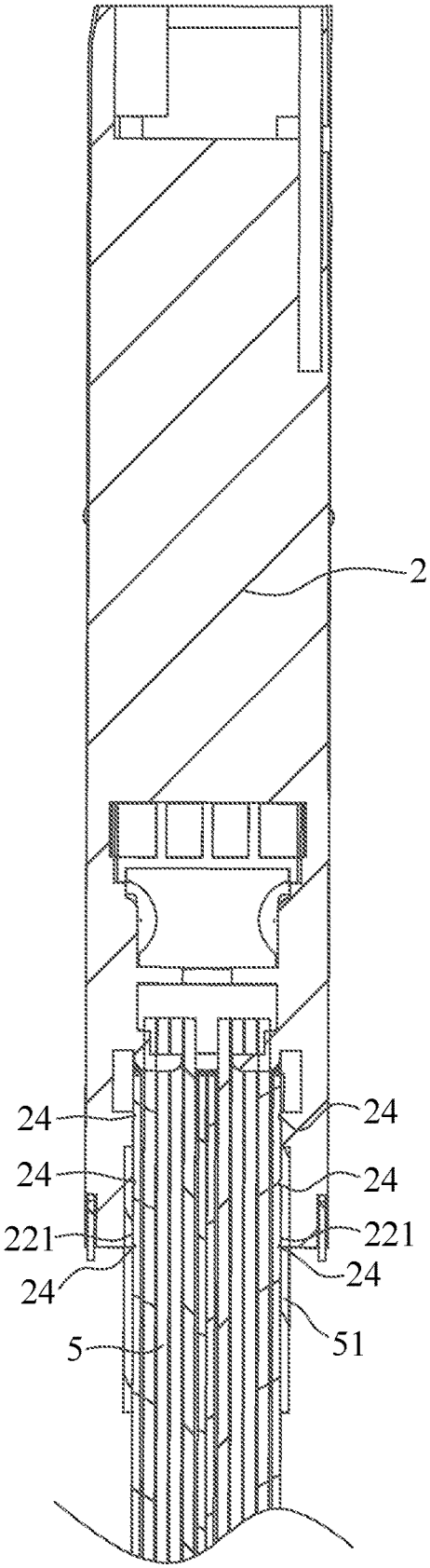
FIG. 7 is a cross-section view of the plug assembly along a line VII-VII of FIG. 5.
Figure 8:
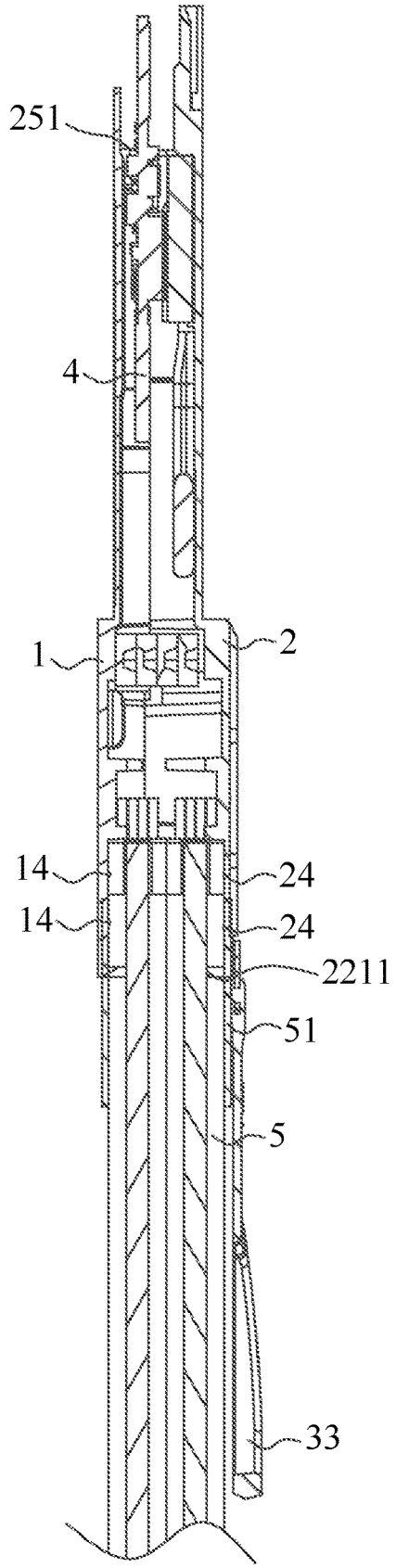
FIG. 8 is a cross-section view of the plug assembly along a line VIII-VIII of FIG. 5.
Figure 9:
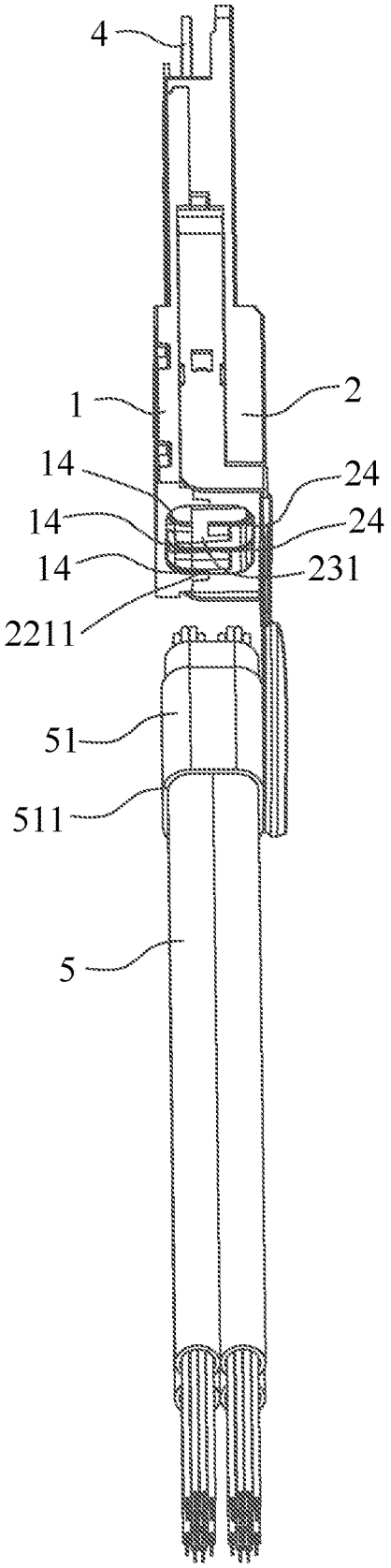
FIG. 9 is a perspective view of the plug assembly, wherein the plurality of the external cables are without being assembled to the plug assembly in accordance with the first preferred embodiment of the present invention.
Figure 10:
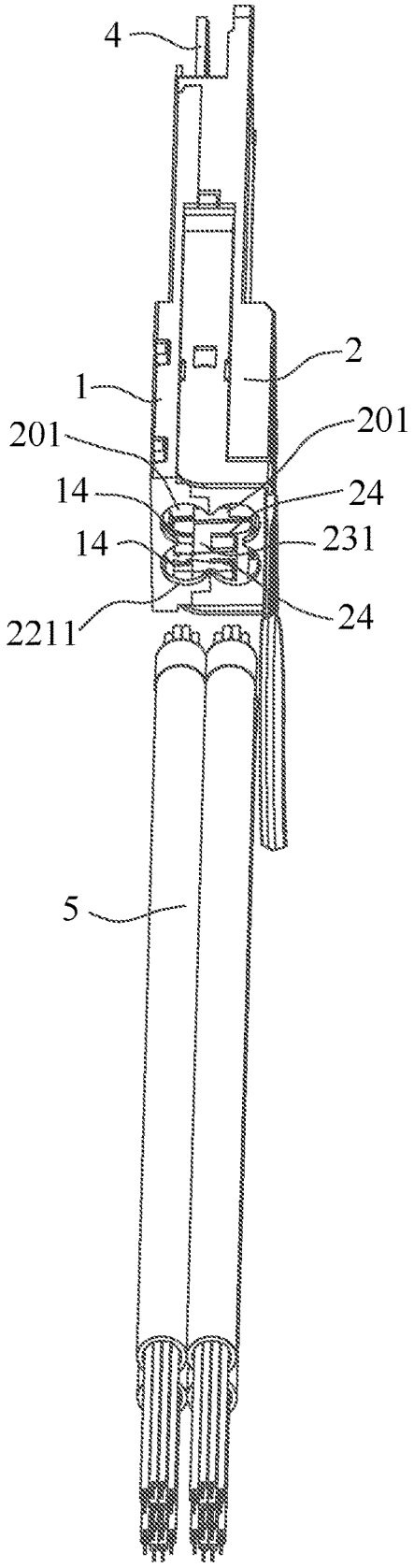
FIG. 10 is a perspective view of the plug assembly, wherein the plurality of the external cables are without being assembled to the plug assembly in accordance with a second preferred embodiment of the present invention.
Figure 11:
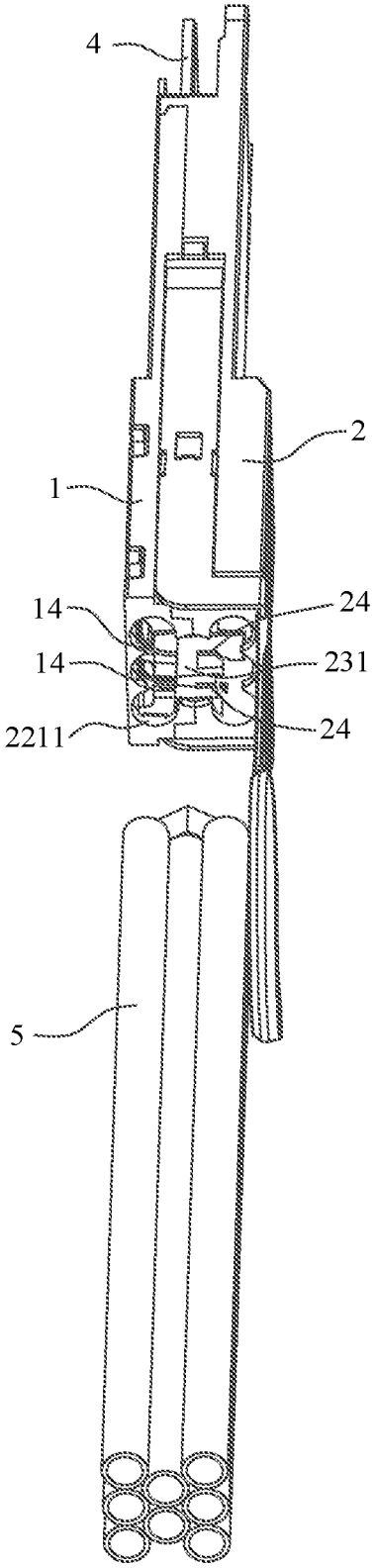
FIG. 11 is a perspective view of the plug assembly, wherein the plurality of the external cables are without being assembled to the plug assembly in accordance with a third preferred embodiment of the present invention.

With reference to FIG. 1 to FIG. 3, a plug assembly 100 in accordance with a first preferred embodiment of the present invention is shown. The plug assembly 100 is a QSFP (Quad Small Form-factor Pluggable) interface. The plug assembly 100 adapted for being connected with a plurality of external cables 5, includes a lower cover 1, an upper cover 2, a receding element 3 and a circuit board 4.

Two sides of the lower cover 1 has two lower lateral walls 11 protruding upward, and a rear end of the lower cover 1 has a lower rear wall 12 protruding upward. A top surface of a lower portion of the lower cover 1, the two lower lateral walls 11 and the lower rear wall 12 surround a lower accommodating space 13. The lower rear wall 12 opens a lower external interface 121 communicated with the lower accommodating space 13. The lower accommodating space 13 of the lower cover 1 has at least one lower embedding portion 14 protruded upward from the top surface of the lower portion of the lower cover 1 and connected with inner surfaces of the two lower lateral walls 11 of the lower cover 1.

The lower cover 1 has a substantially rectangular lower base board 101. Two sides of the lower base board 101 of the lower cover 1 protrude upward to form the two lower lateral walls 11. The two lower lateral walls 11 of the lower cover 1 open a plurality of lower fastening holes 111 vertically penetrating through the two lower lateral walls 11. Upper portions of outer surfaces of the two lower lateral walls 11 of the lower cover 1 are recessed inward to form two lower accommodating grooves 112. A rear end of the lower base board 101 of the lower cover 1 protrudes upward to form the lower rear wall 12. The lower base board 101, the two lower lateral walls 11 and the lower rear wall 12 surround the lower accommodating space 13. A middle of a top of the lower rear wall 12 is recessed downward to form the lower external interface 121 communicated with the lower accommodating space 13.

The lower accommodating space 13 of the lower cover 1 has the at least one lower embedding portion 14 protruded inward from a top surface of the lower base board 101 and connected with the inner surfaces of the two lower lateral walls 11 of the lower cover 1. In the first preferred embodiment, the lower cover 1 has three lower embedding portions 14. Two lower embedding portions 14 are arranged along a front-to-rear direction and are parallel with each other. One lower embedding portion 14 located behind the two lower embedding portions 14 and connected with a front surface of the lower external interface 121. A front of the lower cover 1 opens a lower opening 15 communicated between the lower accommodating space 13 and an outside.

Referring to FIG. 1 to FIG. 10, the upper cover 2 is assembled to the lower cover 1. Two sides of the upper cover 2 have two upper lateral walls 21 protruding downward. The two upper lateral walls 21 are disposed corresponding to the two lower lateral walls 11. A rear end of the upper cover 2 has an upper rear wall 22 protruding downward. The upper rear wall 22 is disposed corresponding to the lower rear wall 12. A bottom surface of an upper portion of the upper cover 2, the two upper lateral walls 21 and the upper rear wall 22 surround an upper accommodating space 23. The upper rear wall 22 opens an upper external interface 221 communicated with the upper accommodating space 23. The upper accommodating space 23 of the upper cover 2 has at least one upper embedding portion 24 protruded downward from the bottom surface of the upper portion of the upper cover 2 and connected with inner surfaces of the two upper lateral walls 21. The at least one upper embedding portion 24 is disposed corresponding to the at least one lower embedding portion 14.

The upper cover 2 has a substantially rectangular upper base board 201. Two sides of the upper base board 201 protrude downward to form the two upper lateral walls 21. The two upper lateral walls 21 of the upper cover 2 open a plurality of upper fastening holes 211 penetrating through bottom surfaces of the two upper lateral walls 21. The plurality of the upper fastening holes 211 are disposed corresponding to and communicated with the plurality of the lower fastening holes 111. Outer surfaces of the two upper lateral walls 21 are recessed inward to form two lying L-shaped upper accommodating grooves 212. The two upper accommodating grooves 212 are disposed corresponding to the two lower accommodating grooves 112. The two upper accommodating grooves 212 and the two lower accommodating grooves 112 are combined to form two accommodating grooves 26, respectively. A rear end of the upper base board 201 of the upper cover 2 protrudes downward to form the upper rear wall 22.

A middle of a bottom surface of the upper rear wall 22 is recessed upward to form the upper external interface 221. The upper external interface 221 is disposed corresponding to the lower external interface 121. The upper external interface 221 is combined with the lower external interface 121 to form an external interface 2211. The upper base board 201, the two upper lateral walls 21 and the upper rear wall 22 surround the upper accommodating space 23. The upper accommodating space 23 is disposed corresponding to the lower accommodating space 13. The upper accommodating space 23 is combined with the lower accommodating space 13 to form an accommodating space 231.

The upper accommodating space 23 of the upper cover 2 has the at least one upper embedding portion 24 protruded downward from a bottom surface of the upper base board 201 and connected with the inner surfaces of the two upper lateral walls 21. In the first preferred embodiment, the upper cover 2 has three upper embedding portions 24. Two upper embedding portions 24 are arranged along the front-to-rear direction and are parallel with each other. One upper embedding portion 24 located behind the two upper embedding portions 24 and connected with a front surface of the upper external interface 221. The three upper embedding portions 24 are disposed corresponding to the three lower embedding portions 14. The upper embedding portion 24 of the upper external interface 221 is disposed corresponding to the lower embedding portion 14 of the lower external interface 121. A front of the upper cover 2 opens an upper opening 25 communicated between the upper accommodating space 23 and the outside. The upper opening 25 is disposed corresponding to the lower opening 15. The upper opening 25 is combined with the lower opening 15 to form an opening 251.

Referring to FIG. 1 and FIG. 2, the receding element 3 has a base portion 31 of an inverted U shape. Bottoms of two ends of the base portion 31 extend downward and then bent frontward to form two fastening arms 32, respectively. A rear end of the base portion 31 is connected with a pulling ring 33. The base portion 31 is mounted to a rear end of a top surface of the upper cover 2. The two fastening arms 32 are mounted in the two accommodating grooves 26, respectively.

When the plug assembly 100 is assembled in an exchanger (not shown), the exchanger has a clamping portion (not shown) for fastening the plug assembly 100 in the exchanger. When the plug assembly 100 is withdrawn from the exchanger, the pulling ring 33 is pulled rearward to make the two fastening arms 32 of the receding element 3 expand outward to open the clamping portion of the exchanger so as to make the plug assembly 100 withdrawn outward.

Referring to FIG. 1 and FIG. 2, the circuit board 4 is disposed between the lower cover 1 and the upper cover 2. The circuit board 4 is accommodated in the accommodating space 231. The plug assembly 100 is connected with and cooperated with the plurality of external cables 5. The plurality of the external cables 5 are connected with a rear end of the circuit board 4 through the external interface 2211. The external interface 2211 is tightly adhered to the plurality of the external cables 5. A front end of the circuit board 4 is exposed outside from the opening 251 of the plug assembly 100.

With reference to FIG. 5 to FIG. 9, a shape of the external interface 2211 is disposed corresponding to a quantity of the plurality of the external cables 5. In the first preferred embodiment, the quantity of the plurality of the external cables 5 is four. Outer peripheries of the four external cables 5 are surrounded by a heat-shrinkable tube 51. The heat-shrinkable tube 51 is shown as a hollow cuboid shape with four outer rounded corners and disposed longitudinally. A front end and a rear end of the heat-shrinkable tube 51 are opened freely. Each two outer surfaces of the cuboid heat-shrinkable tube 51 are connected by an arc-shaped connecting portion 511. The heat-shrinkable tube 51 encloses the four external cables 5 to show a cuboid shape with the four outer rounded corners. In the first preferred embodiment, the shape of the external interface 2211 is of the cuboid shape with the four outer rounded corners and is matched with an outer periphery of the front end of the heat-shrinkable tube 51. The external interface 2211 of the cuboid shape with the four outer rounded corners and the plurality of the external cables 5 of the cuboid shape with the four outer rounded corners are tightly attached to the heat-shrinkable tube 51 to reach a complete sealing effect so as to prevent electromagnetic fields in the plurality of the external cables 5 from dissipating outward. Thus radiation losses of the plurality of the external cables 5 affect other devices.

When the plug assembly 100 is assembled with the plurality of the external cables 5, the insulation layers of the plurality of the external cables 5 have no need of being peeled off, the plurality of the external cables 5 are directly clamped between the upper cover 2 and the lower cover 1 along an up-down direction. Fronts of the plurality of the external cables 5 are accommodated in the accommodating space 231. At the moment, the insulation layers of the plurality of the external cables 5 are pressed between the at least one upper embedding portion 24 and the at least one lower embedding portion 14. In the first preferred embodiment, the insulation layers of the plurality of the external cables 5 are pressed between the three upper embedding portions 24 and the three lower embedding portions 14. The heat-shrinkable tube 51 is pressed into the external interface 2211. The plug assembly 100 further includes a plurality of fixing elements 6. The plurality of the fixing elements 6 pass through the plurality of the lower fastening holes 111 to be inserted into the plurality of the upper fastening holes 211 to make the lower cover 1 and the upper cover 2 fixed with each other, so that the plurality of the external cables 5 are tightly embedded and fastened in the plug assembly 100 by virtue of the at least one upper embedding portion 24 and the at least one lower embedding portion 14.

Referring to FIG. 1 to FIG. 10, the plug assembly 100 in accordance with a second preferred embodiment of the present invention is shown. The plug assembly 100 in accordance with the second preferred embodiment of the present invention is substantially the same as the plug assembly 100 in accordance with the first preferred embodiment of the present invention. Differences between the plug assembly 100 in accordance with the first preferred embodiment and the plug assembly 100 in accordance with the second preferred embodiment are described as follows. The shape of the external interface 2211 of the plug assembly 100 in accordance with the second preferred embodiment is different from the shape of the external interface 2211 of the plug assembly 100 in accordance with the first preferred embodiment. An arrangement way of the plurality of the external cables 5 in accordance with the second preferred embodiment is different from an arrangement way of the plurality of the external cables 5 in accordance with the first preferred embodiment. A cooperation between the external interface 2211 and the plurality of the external cables 5 in accordance with the second preferred embodiment is different from a cooperation between the external interface 2211 and the plurality of the external cables 5 in accordance with the first preferred embodiment.

Referring to FIG. 1 to FIG. 10, in the second preferred embodiment, the plug assembly 100 includes four external cables 5. The external interface 2211 includes four circular perforations 201 of which shapes are corresponding to the four external cables 5. The external interface 2211 is tightly adhered to the four external cables 5 to reach the complete sealing effect so as to prevent the electromagnetic fields in the four external cables 5 from dissipating outward. Thus the radiation losses of the four external cables 5 are avoided from affecting the other devices.

Referring to FIG. 1 to FIG. 11, the plug assembly 100 in accordance with a third preferred embodiment of the present invention is shown. The plug assembly 100 in accordance with the third preferred embodiment is substantially the same as the plug assembly 100 in accordance with the first preferred embodiment and the second preferred embodiment. Differences between the plug assembly 100 in accordance with the third preferred embodiment and the plug assembly 100 in accordance with the first preferred embodiment and the second preferred embodiment are described as follows. The shape of the external interface 2211 of the plug assembly 100 in accordance with the third preferred embodiment is different from the shape of the external interface 2211 of the plug assembly 100 in accordance with the first preferred embodiment and the second preferred embodiment. An arrangement way of the plurality of the external cables 5 in accordance with the third preferred embodiment is different from the arrangement way of the plurality of the external cables 5 in accordance with the first preferred embodiment and the second preferred embodiment. A cooperation between the external interface 2211 and the plurality of the external cables 5 in accordance with the third preferred embodiment is different from the cooperation between the external interface 2211 and the plurality of the external cables 5 in accordance with the first preferred embodiment and the second preferred embodiment.

Referring to FIG. 1 to FIG. 11, in the third preferred embodiment, the quantity of the plurality of the external cables 5 is eight. The plurality of the external cables 5 are arranged in three rows along the up-down direction. The three rows of the external cables 5 include three external cables 5, two external cables 5 and three external cables 5 arranged in sequence and along the up-down direction. In the third preferred embodiment, The external interface 2211 includes eight circular perforations 201 of which shapes are corresponding to the eight external cables 5. The eight circular perforations 201 of the external interface 2211 include three circular perforations 201, two circular perforations 201 and third circular perforations 201 arranged in sequence and along the up-down direction. The external interface 2211 is tightly adhered to the eight external cables 5 to reach the complete sealing effect so as to prevent the electromagnetic fields in the eight external cables 5 from dissipating outward. Thus the radiation losses of the eight external cables 5 are avoided from affecting the other devices.

As described above, the plurality of the external cables 5 are directly embedded and fastened in the plug assembly 100 by virtue of disposing the at least one upper embedding portion 24, the at least one lower embedding portion 14 and the external interface 2211, a previous procedure of peeling off the insulation layers of the plurality of the external cables 5 is saved, and the radiation losses dissipated from the plurality of the external cables 5 are also lowered.

What is claimed is:

1. A plug assembly, comprising:

a lower cover, two sides of the lower cover having two lower lateral walls protruding upward, and a rear end of the lower cover having a lower rear wall protruding upward, a top surface of a lower portion of the lower cover, the two lower lateral walls and the lower rear wall surrounding a lower accommodating space, the lower rear wall opening a lower external interface communicated with the lower accommodating space, the lower accommodating space having at least one lower embedding portion protruded upward from the top surface of the lower portion of the lower cover and connected with inner surfaces of the two lower lateral walls;

a circuit board; and an upper cover assembled to the lower cover, two sides of the upper cover having two upper lateral walls protruding downward and corresponding to the two lower lateral walls, a rear end of the upper cover having an upper rear wall protruding downward and corresponding to the lower rear wall, a bottom surface of an upper portion of the upper cover, the two upper lateral walls and the upper rear wall surrounding an upper accommodating space corresponding to the lower accommodating space, the upper accommodating space being combined with the lower accommodating space to form an accommodating space, the upper rear wall opening an upper external interface communicated with the upper accommodating space and disposed corresponding to the lower external interface, the upper external interface being combined with the lower external interface to form an external interface, the upper accommodating space having at least one upper embedding portion protruded downward from the bottom surface of the upper portion of the upper cover and connected with inner surfaces of the two upper lateral walls, the at least one upper embedding portion being disposed corresponding to the at least one lower embedding portion;

wherein the plug assembly is connected with and cooperates with a plurality of external cables, the plurality of the external cables are connected with the circuit board through the external interface, a quantity of the plurality of the external cables is eight, the plurality of the external cables are arranged in three rows along an up-down direction, the three rows of the external cables include three external cables, two external cables and three external cables arranged in sequence and along the up-down direction, the external interface includes eight circular perforations of which shapes are corresponding to the eight external cables, the eight circular perforations of the external interface include three circular perforations, two circular perforations and third circular perforations arranged in sequence and along the up-down direction, the external interface is tightly adhered to the eight external cables.

2. The plug assembly as claimed in claim 1, wherein the lower cover has one lower embedding portion connected with a front surface of the lower external interface, the upper cover has one upper embedding portion connected with a front surface of the upper external interface, and the upper embedding portion connected with the upper external interface is disposed corresponding to the lower embedding portion connected with the lower external interface.

3. The plug assembly as claimed in claim 1, wherein a front of the lower cover opens a lower opening, a front of the upper cover opens an upper opening, the upper opening is disposed corresponding to the lower opening, the upper opening is combined with the lower opening to form an opening, the circuit board is disposed between the lower cover and the upper cover, and a front end of the circuit board is exposed outside from the opening.

4. The plug assembly as claimed in claim 1, wherein the two lower lateral walls of the lower cover open a plurality of lower fastening holes, the two upper lateral walls of the upper cover open a plurality of upper fastening holes, the plurality of the upper fastening holes are disposed corresponding to and communicated with the plurality of the lower fastening holes, the plug assembly further includes a plurality of fixing elements, the plurality of the fixing elements pass through the plurality of the lower fastening holes to be inserted into the plurality of the upper fastening holes to make the lower cover and the upper cover fixed with each other.

5. The plug assembly as claimed in claim 1, wherein outer surfaces of the two lower lateral walls of the lower cover are recessed inward to form two lower accommodating grooves, outer surfaces of the two upper lateral walls of the upper cover are recessed inward to form two upper accommodating grooves, the two upper accommodating grooves are disposed corresponding to the two lower accommodating grooves, the two upper accommodating grooves and the two lower accommodating grooves are combined to form two accommodating grooves, respectively, the plug assembly further includes a receding element which has a base portion of an inverted U shape, bottoms of two ends of the base portion extend downward and then bent frontward to form two fastening arms, respectively, a rear end of the base portion is connected with a pulling ring, the base portion is mounted to a top surface of the rear end of the upper cover, the two fastening arms are mounted in the two accommodating grooves, respectively.

6. A plug assembly adapted for being connected with a plurality of external cables, the plug assembly comprising:

a lower cover having two lower lateral walls protruding upward, and a lower rear wall protruding upward, a top surface of a lower portion of the lower cover, the two lower lateral walls and the lower rear wall surrounding a lower accommodating space, the lower rear wall opening a lower external interface communicated with the lower accommodating space, the lower accommodating space having at least one lower embedding portion protruded upward from the top surface of the lower portion of the lower cover and connected with inner surfaces of the two lower lateral walls;

an upper cover assembled to the lower cover, the upper cover having two upper lateral walls protruding downward and corresponding to the two lower lateral walls, and an upper rear wall protruding downward and corresponding to the lower rear wall, a bottom surface of an upper portion of the upper cover, the two upper lateral walls and the upper rear wall surrounding an upper accommodating space corresponding to the lower accommodating space, the upper accommodating space being combined with the lower accommodating space to form an accommodating space, the upper rear wall opening an upper external interface communicated with the upper accommodating space and disposed corresponding to the lower external interface, the upper external interface being combined with the lower external interface to form an external interface, the upper accommodating space having at least one upper embedding portion protruded downward from the bottom surface of the upper portion of the upper cover and connected with inner surfaces of the two upper lateral walls, the at least one upper embedding portion being disposed corresponding to the at least one lower embedding portion; and a circuit board accommodated in the accommodating space, the plurality of the external cables being connected with a rear end of the circuit board through the external interface, fronts of the plurality of the external cables being accommodated in the accommodating space, the plurality of the external cables being pressed between the at least one upper embedding portion and the at least one lower embedding portion;

wherein the plug assembly is connected with and cooperates with a plurality of external cables, the plurality of the external cables are connected with the circuit board through the external interface, a quantity of the plurality of the external cables is eight, the plurality of the external cables are arranged in three rows along an up-down direction, the three rows of the external cables include three external cables, two external cables and three external cables arranged in sequence and along the up-down direction, the external interface includes eight circular perforations of which shapes are corresponding to the eight external cables, the eight circular perforations of the external interface include three circular perforations, two circular perforations and third circular perforations arranged in sequence and along the up-down direction, the external interface is tightly adhered to the eight external cables.

7. A plug assembly, comprising:

a lower cover having a lower base board, two sides of the lower base board protruding upward to form two lower lateral walls, a rear end of the lower base board protruding upward to form a lower rear wall, the lower base board, the two lower lateral walls and the lower rear wall surrounding a lower accommodating space, a top of the lower rear wall being recessed downward to form a lower external interface communicated with the lower accommodating space, the lower accommodating space having at least one lower embedding portion protruded inward from a top surface of the lower base board and connected with inner surfaces of the two lower lateral walls; and an upper cover assembled to the lower cover, having an upper base board, two sides of the upper base board protruding downward to form two upper lateral walls disposed corresponding to the two lower lateral walls, a rear end of the upper base board protruding downward to form an upper rear wall disposed corresponding to the lower rear wall, the upper base board, the two upper lateral walls and the upper rear wall surrounding an upper accommodating space disposed corresponding to the lower accommodating space, the upper accommodating space being combined with the lower accommodating space to form an accommodating space, a bottom surface of the upper rear wall being recessed upward to form an upper external interface disposed corresponding to the lower external interface, the upper external interface being combined with the lower external interface to form an external interface, the upper accommodating space having at least one upper embedding portion protruded downward from a bottom surface of the upper base board and connected with inner surfaces of the two upper lateral walls, the at least one upper embedding portion being disposed corresponding to the at least one lower embedding portion;

wherein the plug assembly is connected with and cooperates with a plurality of external cables, the plurality of the external cables are connected with a circuit board through the external interface, a quantity of the plurality of the external cables is eight, the plurality of the external cables are arranged in three rows along an up-down direction, the three rows of the external cables include three external cables, two external cables and three external cables arranged in sequence and along the up-down direction, the external interface includes eight circular perforations of which shapes are corresponding to the eight external cables, the eight circular perforations of the external interface include three circular perforations, two circular perforations and third circular perforations arranged in sequence and along the up-down direction, the external interface is tightly adhered to the eight external cables.

* * * * *